350-331 SR
10/26/82 XR 4,356,483

United States Patent [19]

Fujita et al.

[11] 4,356,483

[45] Oct. 26, 1982

[54] MATRIX DRIVE SYSTEM FOR LIQUID CRYSTAL DISPLAY

[75] Inventors: Hiroo Fujita, Sayama; Akira Tsuzuki, Tokyo, both of Japan

[73] Assignee: Citizen Watch Company, Limited, Tokyo, Japan

[21] Appl. No.: 168,138

[22] Filed: Jul. 14, 1980

Related U.S. Application Data

[63] Continuation of Ser. No. 877,032, Feb. 10, 1978, abandoned.

[30] Foreign Application Priority Data

Feb. 14, 1977 [JP] Japan ..... 52-14287
Apr. 30, 1977 [JP] Japan ..... 52-50584

[51] Int. Cl.[3] ..... G09G 3/36

[52] U.S. Cl. ..... 340/805; 340/784; 350/331 R

[58] Field of Search ..... 340/805, 784, 765, 789; 350/330–333

[56] References Cited

U.S. PATENT DOCUMENTS

| | | | |
|---|---|---|---|
| 3,776,615 | 12/1973 | Tsukamoto et al. | 340/805 |
| 3,789,388 | 1/1974 | Medwin | 340/805 |
| 3,898,642 | 8/1975 | Dorey et al. | 340/805 |
| 4,117,472 | 9/1978 | Freer et al. | 340/805 |
| 4,186,395 | 1/1980 | Fujita et al. | 340/805 |

*Primary Examiner*—Marshall M. Curtis

[57] ABSTRACT

A method and drive system for driving an electro-optical display device having a matrix of an n-number of digit electrodes having a plurality of electrodes groups spaced from one another, and a plurality of groups of segment electrodes associated with each of said electrode groups to provide a plurality of display elements at each of the groups. m-number of digit electrodes are simultaneously applied with excitation voltages each having at least two potential levels opposite in porality during an excitation period of:

$$1/n < t \leqq m/n$$

where t represents the excitation period during which period n-m number of digit electrodes are applied with a non-excitation or reference voltage having a potential level intermediate between the potential levels of the excitation voltages. Each of the segment electrodes has applied thereto a voltage having potential levels opposite in polarity to the potential levels of the excitation voltage during the excitation period and having the same potential level as that of the non-excitation voltage during a non-excitation period, whereby a plurality of those of the display elements on each digit electrode are concurrently driven in each frame time.

3 Claims, 29 Drawing Figures

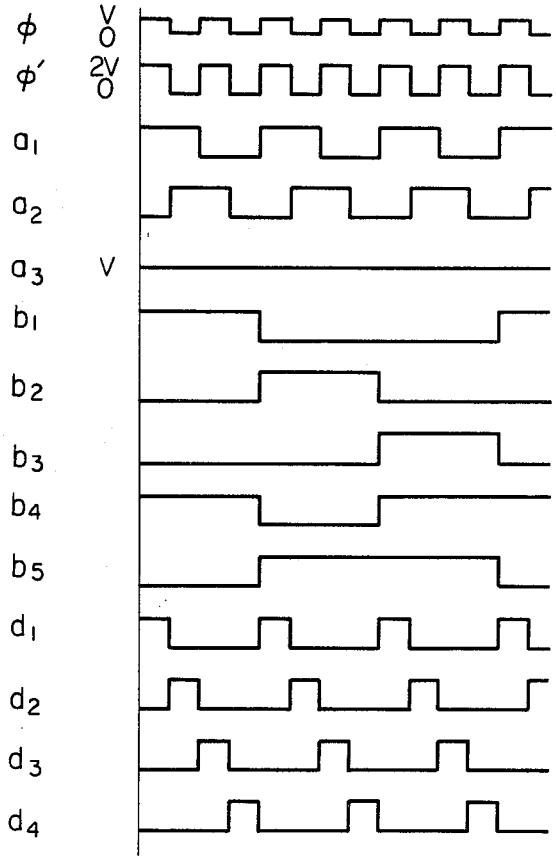
Fig. 9
Fig. 10
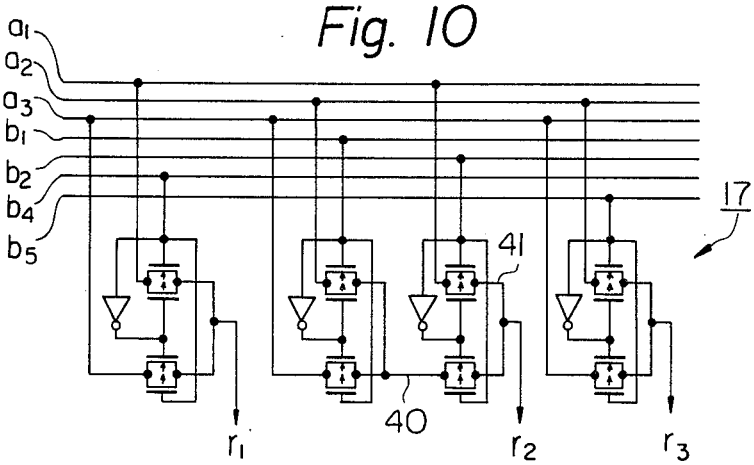

MATRIX DRIVE SYSTEM FOR LIQUID CRYSTAL DISPLAY

This is a continuation, of application Ser. No. 877,032, filed Feb. 10, 1978 and now abandoned.

BACKGROUND OF THE INVENTION

This invention relates to driving methods for a liquid crystal matrix display device, and more particularly to a matrix drive system which consumes less power than prior art systems through simple drive circuitry that is capable of producing a distinct display with little cross-talk.

At the present time, the matrix which constitutes a liquid crystal display device (hereinafter referred to as LCD) is generally driven on the basis of a $\frac{1}{2}$ or $\frac{1}{3}$ bias method obtained by a method of averaging voltages. The $\frac{1}{2}$ bias method requires two power sources (three potential levels), while the $\frac{1}{3}$ bias method requires three or four power sources (4 or 5 potential levels). In terms of an operation margin k when driving an n digit (n now) matrix, the following relationships exit:

$$\tfrac{1}{2}\text{ bias method: } k = \sqrt{\frac{n+3}{n-1}}$$

$$\tfrac{1}{3}\text{ bias method: } k = \sqrt{1+\frac{8}{n}}$$

Accordingly, for a case in which n>2, but where n is not excessively large, the $\frac{1}{3}$ bias method provides a greater operation margin than the $\frac{1}{2}$ bias method, so that driving a matrix by the $\frac{1}{3}$ bias method proves the most beneficial as determined by the characteristics of the optical threshold voltage $V_{TH}$ and optical saturation voltage Vs. However, the $\frac{1}{3}$ bias method requires the greater number of driving power sources, an undesirable condition for displays in electronic timepieces and calculators where low power consumption is essential.

SUMMARY OF THE INVENTION

It is therefore an object of the present invention to provide a method of driving an electro-optical display device arranged in a matrix configuration with a reduced power consumption.

It is another object of the present invention to provide a driving method for a liquid crystal display device arranged in a matrix configuration, which method makes it possible to drive the display device using fewer potential levels.

It is another object of the present invention to provide a matrix drive system for an electro-optical display device, which system is arranged to drive the display device with a low power consumption using fewer potential levels.

In accordance with the present invention, an electro-optical display device has an n-number of digit electrodes and a plurality of segment electrodes arrayed in a matrix configuration to form a plurality of display elements or segments at intersections, wherein, in each frame time, m-number of digit electrodes are simultaneously energized with excitation voltages during an excitation period of:

$$l/n < t \leqq m/n$$

where t represents an excitation period. In this instance, n-m number of digit electrodes are energized with non-excitation voltage during a non-excitation period of m/n. Each of the excitation voltages has at least two potential levels opposite in polarity, and each of the non-excitation voltages has a potential level intermediate between the two potential levels of the excitation voltage and serves as a reference voltage. A segment drive signal applied to the segment electrode has potential levels different from the potential levels of the excitation voltage when the display elements are to be rendered light-scattering state during the excitation period and has the same potential level as that of the non-excitation voltage and the same potential level as one of the two potential levels of the excitation voltage when the display elements are to be rendered light-transparent state. The digit electrodes to be excited in combination are sequentially and cyclically changed in each frame time, and the digit electrodes are excited during the same time period in each frame time.

BRIEF DESCRIPTION OF THE DRAWINGS

The objects, features and advantages of the present invention will become more apparent from the following description when taken in conjunction with the accompanying drawings, in which:

FIG. 9 is a timing chart of control signals produced by the circuit of FIG. 8;

FIG. 10 shows a digit electrode driver forming part of the drive system shown in FIG. 5;

DESCRIPTION OF THE PREFERRED EMBODIMENTS

Figure 1:
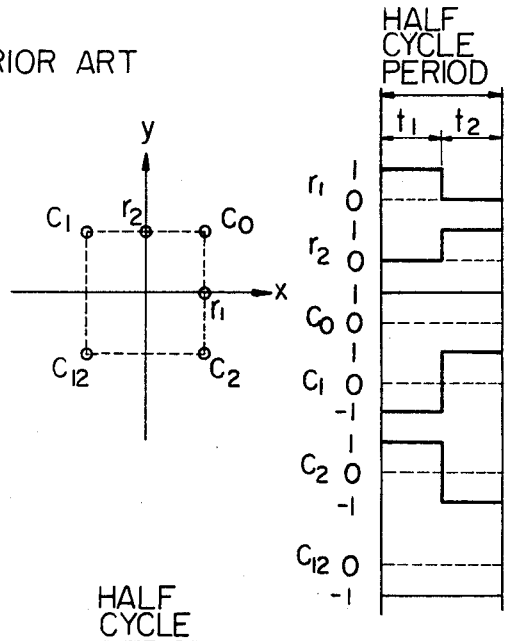
Fig. 1 PRIOR ART
FIG. 1 is a diagram useful for explaining a prior art drive system for a liquid crystal display device.

Referring now to FIG. 1, there is shown conventional waveforms and graphs in which these waveforms are expressed in a coordinate system, the waveforms representing drive signals applied to digit electrodes and segment electrodes of a liquid crystal display device. Here, n, the number of digit electrodes, is equal to 2. The drive signals are shown for a half cycle period. Signals applied t the digit electrodes are designated by r1 and r2, the signals applied to the segment electrodes by Co, C1, C2 and C12, wherein the subscripts of the segment electrode drive signals denote which segment (display element) at a cross point with a corresponding digit is in a light-scattering state. For example, C1 represents a segment electrode drive signal which induces a light-scattering state at a display element corresonding to a digit electrode r1, and a light-transparent state at a display element corresponding to a digit electrode r2. When n=2, four driving signals are necessary. The intervals t1, t2 in the half cycle period of the driving waveforms correspond to the x- and y-axes of the graphs. The maximum absolute values of r1, Co, r2, C1, C12 and C2 on the x- and y-axes are all 1. Since three values are used, namely −1, 0 and 1, this represents a drive system based on a $\frac{1}{2}$ bias method. If a drive system based on a $\frac{1}{3}$ bias method were to be represented, the coordinates of Co, C1, C1, C12 would be the same as depicted in FIG. 1, but the coordinates of r1 and r2 would become (2, 0) and (0, 2) respectively.

In FIG. 1, the rms voltage $V_{off}$ applied to a display element to render it light-transparent is, for example, proportional to the length of line segment Co r1, while the rms voltage $V_{on}$ applied to a display element to render it light-scattering is proportional, for example, to the length of segment C1 r1; it can thus be readily understood that $V_{on}/V_{off}=\sqrt{5}$.

The description of the conventional waveforms based on FIG. 1 where n=2 also holds for a case in which a typical n-digit matrix is driven. The voltage waveforms of digit electrode drive signals r1, r2. . . rn applied to repsective n-number of digit electrodes are applied over a single period comprised of a characteristic half cycle period and a half cycle period in which the waveforms have an orientation opposed to that which they possess in the first half cycle period. Each half cycle is subdivided into n-number of equivalent time slots which are assigned to respective digits, a voltage waveform to be applied to a given segment electrode being decided according to the state at the cross points of the matrix, i.e., whether light-transparent or light-scattering. If 1 frame time (period) of the drive signals is denoted by T, the address time for each digit is given by T/n. In order to achieve all possible displays in an n-digit matrix, $2^n$ segment electrode drive signals are required.

Figure 2:
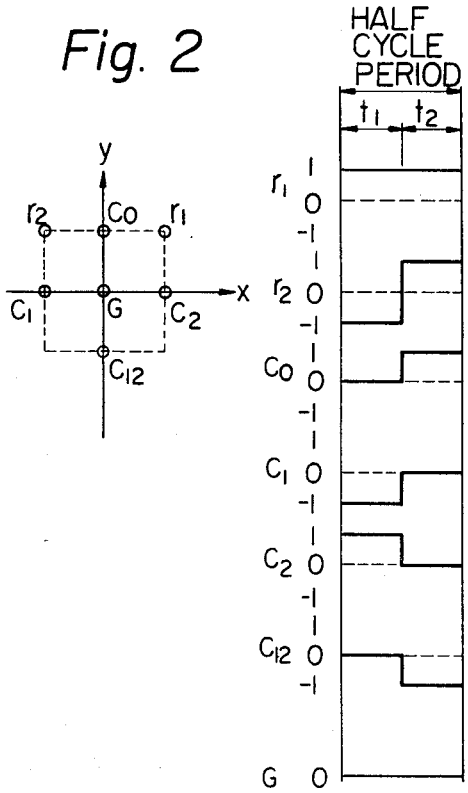
FIG. 2 is a diagram useful for explaining driving signals employed in a driving method of the present invention.

FIG. 2 shows a transformation of the coordinates in FIG. 1, and illustrates a half cycle period of the corresponding driving waveforms. Here, r1=(1,1), r2=(−1,1), Co=(0,1), C1=(−1,0), C2=(1,0), C12=(0,−1). As in FIG. 1, it can readily be understood that $V_{on}V_{off}=\sqrt{5}$ in the present example. These driving waveforms are the basic forms of the driving signals used in the drive system of the present invention for the purpose of driving a matrix. The character G in the graph serves as the origin (0,0) and represents the reference potential of the driving signals. r1 and r2 in one period (1 frame time) possess potential levels other than the reference potential and have the same potential for a time equal to $\frac{1}{2}$ of one period. On the contrary, r1 and r2 in FIG. 1 do not possess identical potential levels in any interval of one period, and have the reference potential for a time equal to $\frac{1}{2}$ of one period. The waveforms in the remaining half cycle period of FIG. 2 have an opposed orientation to that of the first half cycle period with respect to the reference potential 0. The reference potential is the intermediate value 0 of the three potentials −1, 0, 1.

Figure 3:
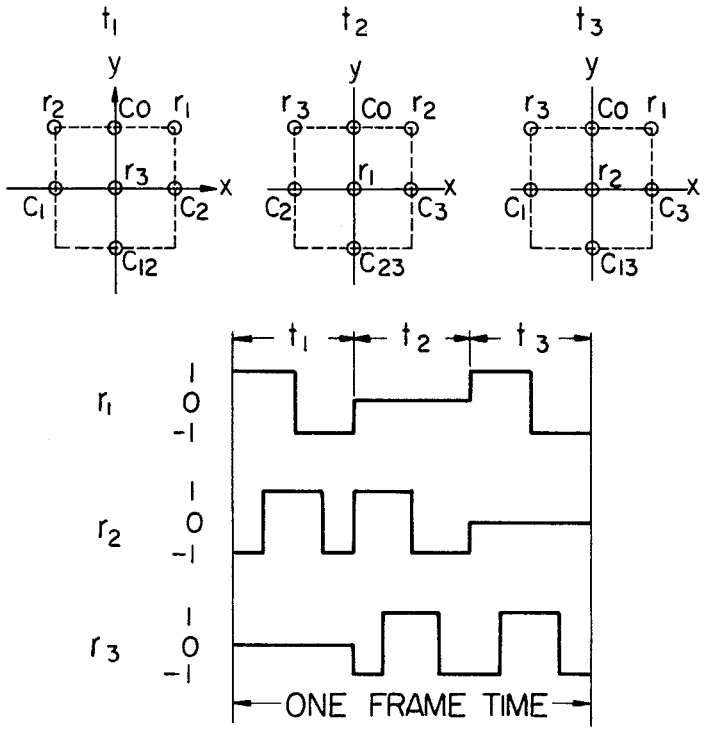
FIG. 3 illustrates graphs of waveforms and coordinates useful in explaining a matrix drive system of the present invention in a case where n=3.

FIG. 3 illustrates 1 frame time of driving waveforms employed in a driving method of the present invention for a case in which n=3. Digit drive signals r3, r1, r2 have a reference or non-excitation potential 0 during time intervals t1, t2, t3, respectively. In other words, in each of the stated intervals any two of the waveforms r1, r2, r3 have excitation potential levels of −1 and 1 only, while the remaining waveform has the reference potential for the entire duration of that interval. The reference potential has a level intermediate between the potentials of the excitation voltage. If an interval in which a digit drive signal has potential levels other than the reference potential is referred to as an excitation period, two digit electrodes will be simultaneously excited in said excitation period. This excitation period is constant and exists for all digits in 1 frame time.

Figure 4:
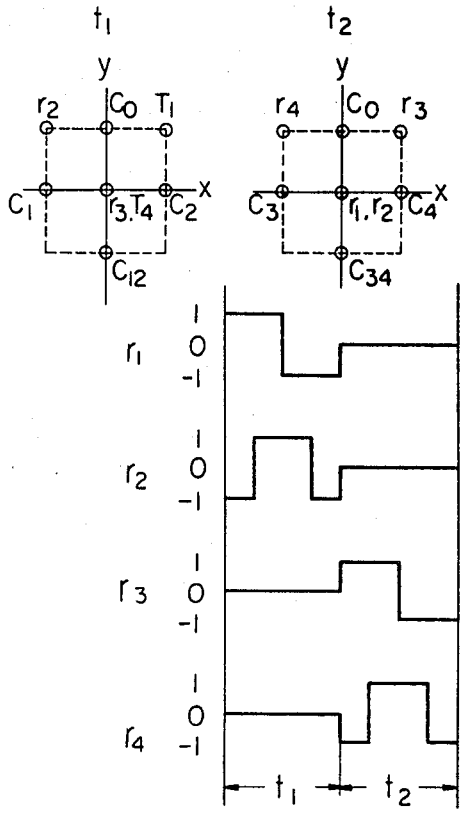
FIG. 4 illustrates graphs of waveforms and coordinates useful in explaining a matrix drive system of the present invention in a case where n=4.

In FIG. 4, there is shown a case in which n=4. In this example, digit drive signals r1, r2 simultaneously reside in the excitation period during time interval t1, while digit drive signals r3 and r4 have the reference potential. In the next time period t2, r3 and r4 are located in the excitation period while r1 and r2 has the reference potential.

In FIGS. 3 and 4 the segment electrode drive signals are located at the same coordinate; only the subscripts differ. This follows since typically only four segment drive signals C0, C1, C2, C12 are sufficient, and that it suffices only to determine the light-transparent or light-scattering states of the segment electrodes corresponding to the two digit electrodes which are being excited. With regard to digit electrodes which are not in the excited state and thus are at the reference potential, the coordinates show that there should be applied an rms voltage equivalent to the rms voltage applied at the time that a light-transparent state is induced at digit electrodes among those that are being excited.

Generally in an n-digit matrix it suffices to simultaneously excite two digit electrodes using combinations (r1, r2), (r3, r4),. . . ($r_{n-1}$, rn) when n is n even number, and combinations of (r1, r2). . . ($r_{n-2}$, $r_{n-1}$), $r_n$, r1), (r2, r3). . .($r_{n-1}$, $r_n$), or (r1, r2), (r1, r3), (r4, r5). . .($r_{n-1}$, rn), (r2, r3), (r4, r5). . .($r_{n-1}$,rn) when n is an odd number. In this case (n-2) digit electrodes are applied with the reference potential.

In the case of the light-scattered elements in FIG. 3, the rms voltage $V_{on}^2$ is proportional to $(\sqrt{5})^2+1^2+(\sqrt{5})^2=11$, and the rms voltage $V_{off}^2$ for the light-transparent elements is proportional to $1^2+1^2+1^2=3$, all of these values based on the length of the line segments. Thus, $V_{on}/V_{off}=\sqrt{11/3}$.

In the case of FIG. 4, $V_{on}^2$ is proportional to $1^2+(\sqrt{5})^2=6$, and $V_{off}^2$ is proportional to $1^2+1^2=2$; hence, $V_{on}/V_{off}=\sqrt{3}$.

Figure 5:
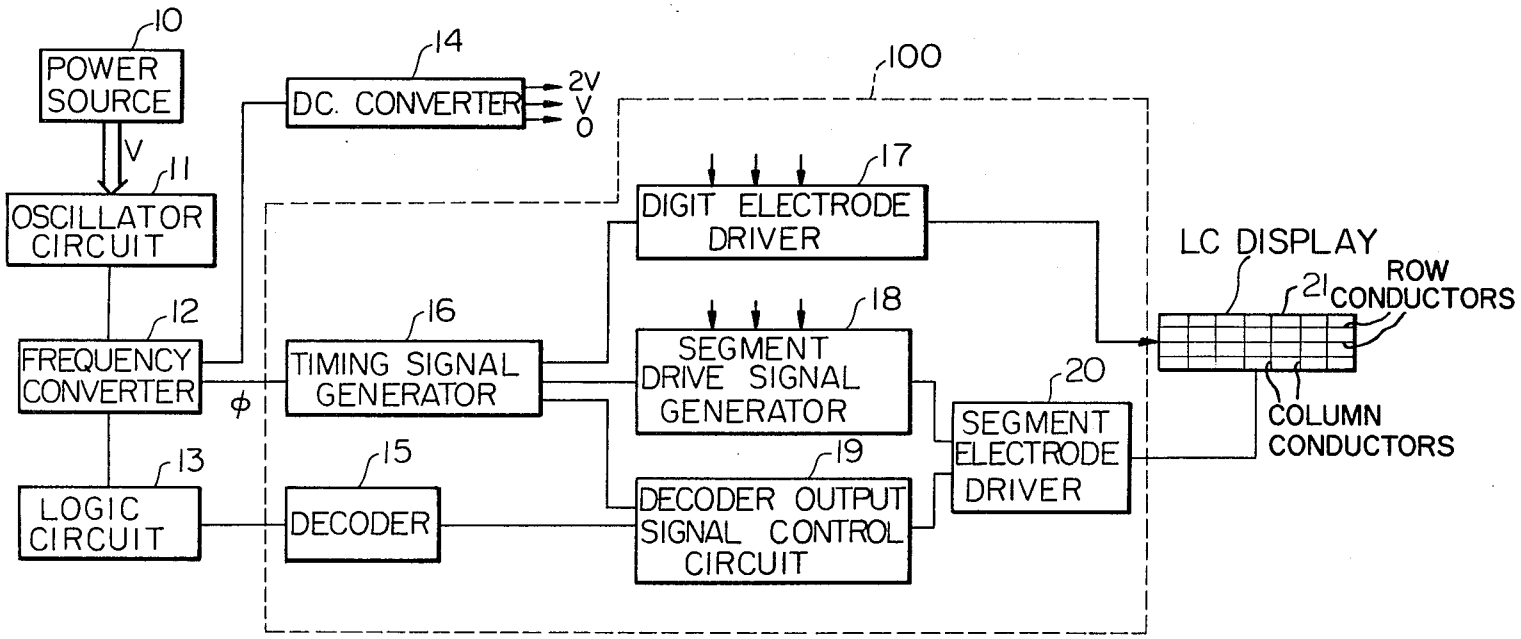
FIG. 5 is a block wiring diagram of a preferred embodiment of a matrix drive system in accordance with the present invenion.

FIG. 5 is a 1st embodiment of a block wiring diagram of a display drive system according to the present invention. Designated at 10 is a power source which generates an output voltage V, at 11 an oscillator circuit which may be crystal controlled to provide a relatively high frequency signal, at 12 a frequency converter to produce a low frequency signal in response to the relatively high frequency signal, and at 13 a logic circuit arranged to produce an output data in response to the low frequency signal. The logic circuit 13 may be a part of a timepiece, calculator, etc. A DC converter 14 is responsive to the low frequency signals from the frequency converter 12 and generates a 2V output voltage signal by boosting the battery voltage V. The DC converter 14 can also be used to generate, by way of example, an output voltage of V/2 by stepping down the battery voltage V. However, the DC converter 14 need not be utilized if the power source 10 initially is capable of delivering two different voltages of V and 2V. Reference numeral 15 denotes a decoder circuit which produces a decoded output in response to the output data produced by the logic circuit, 16 a timing signal generator for generating a variety of timing signals in response to the clock signal $\phi$ delivered from the frequency converter 12, 17 a digit electrode driver arranged to produce the digit drive signals, and 18 a segment drive signal generator which produces segment drive signals C0, C1, C2, C12 illustrated in FIG. 2. Reference numeral 19 designates a decoder output signal control circuit. Each of the blocks 17, 18, 19 are responsive to signals delivered from the timing signal generator 16. Finally, a segment electrode driver is designated at 20, and the liquid crystal display device 21 includes a matrix of a plurality of digit electrodes and a plurality of segment electrodes as will be described in later in detail. The drive circuitry of the present invention relates to the structure of the circuits enclosed in block 100. A detailed description of circuit operation for an example in which n=3 is as follows.

Figure 6A:
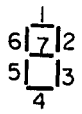
FIGS. 6A to 6D show electrode arrangements when n=3.
Figure 6B:
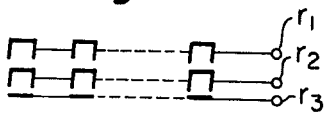
Figure 6D:
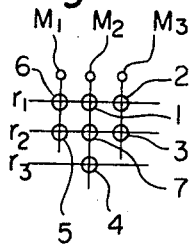
Figure 6C:
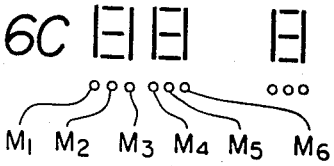

FIGS. 6A to 6D show the electrode arrangements for a 7-segment display used to form a numeric pattern, where n=3. FIG. 6A illustrates each element of seven segments numbered from 1 to 7; FIG. 6B illustrates one example of the digit electrode divisions; FIG. 6C shows the segment electrode divisions corresponding to the digit electrodes; and FIG. 6D illustrates a model of the interconnections between digit electrodes r1, r2, r3 and segment electrodes M1, M2, M3 used to form the display of a single digit. In the present matrix, the digit electrodes are excited in the order illustrated in FIG. 3.

Figure 7A:
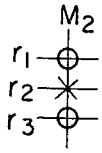
FIGS. 7A and 7B shows a display pattern when n=3.
Figure 7B:
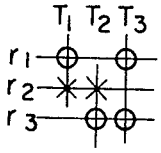

FIGS. 7A and 7B show an exmple of how a segment electrode drive signal is applied in compliance with a particular display pattern. FIG. 7A depicts an example of a pattern of display elements belonging to electrode M2. The pattern represents a light-scattering state at the display elements located at the cross poins (r1. M2) and (r3. M2), and a light-transparent state at the display elements located at the cross point (r2. M2). In accordance with the examples given in FIGS. 2 and 3, it can readily be understood that it sufficies to apply electrode M2 with signal C1 during time t1, signal C2 during time t2, and signal C12 during time t3. Drive circuit operation in accordance with this example will now be described with reference to the drawings beginning with FIGS. 8.

Figure 8:
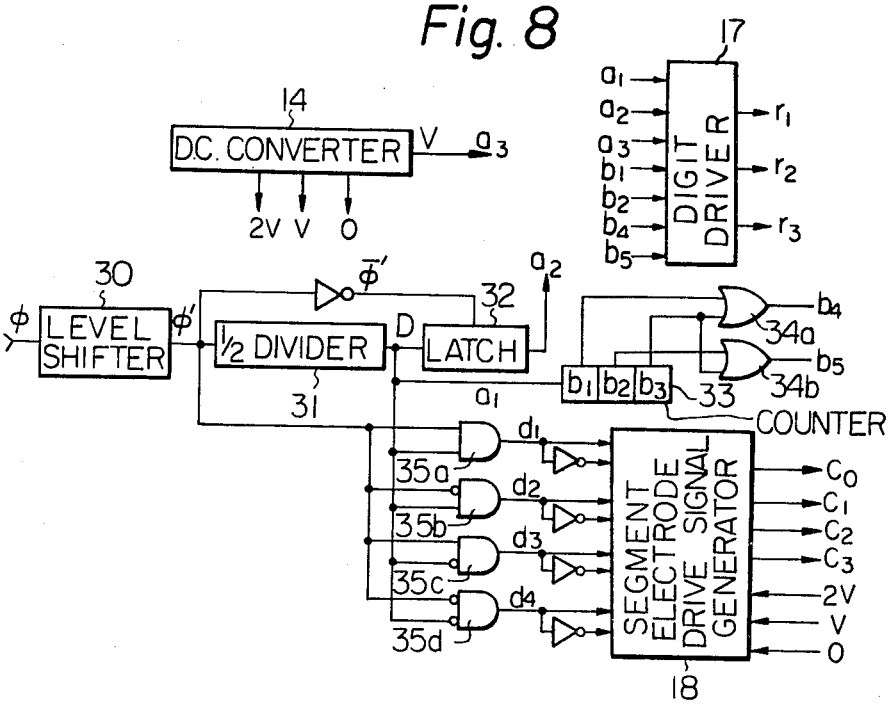
FIG. 8 shows a timing signal generator forming part of the drive system shown in FIG. 5.

FIG. 8 shows an embodiment of the timing signal generator, and FIG. 9 illustrates a timing chart of the various output signals generated by the timing signal generator shown in FIG. 8. The output signal $\phi$ of a voltage V from frequency converter 12 is coupled to a level shifer 30 which produces a signal $\phi'$ having a potential 2V in phase with and having the same frequency as signal $\phi$. The signal $\phi'$ is applied to a divide-by-2 frequency divider 31 which produces a signal a1 which is also applied as an input signal D to a latch circuit 32 to which a clock pulse $\overline{\phi}$ is also applied, whereby the latch circuit produces a signal a2. Further, signal a1 is coupled to a divide-by-3 counter 33 that generates signals b1, b2, b3. Signals b4, b5 are produced by OR gates **34*a*, 34*b*, respectively. A signal a3, actually a potential V, is obtained from power source circuitry or the DC converter 14. The signals a1, a2, a3, b1, b2, b4, b5 are coupled to digit driver 17 which produces the digit drive signals r1, r2, r3. The signals 1 and $\phi'$ are also applied to AND gates 35*a*, 35*b*, 35*c* and 35*d* which produce output signals d1, d2, d3, d4. Through the use of invertors, signals d1, $\overline{d1}$, d2, $\overline{d2}$, d3, $\overline{d3}$, d4, $\overline{d4}$ are coupled to the segment electrode drive signal generator 1 which generates the segment drive signals C0, C1, C2, and C12**.

FIG. 10 depicts an embodiment of digit electrode driver 17 which in this case makes use of transmission gates. The r1 digit driver outputs signal a1 when signal b4 is at an H logic level and signal a3 when signal b4 is at an L level, and the r3 digit driver outputs signal a2 when signal b5 is at an H level and signal a3 when signal b5 is at an L level. The r2 digit driver outputs signal a2 when signal b1 is at an H level; hence, since signal b2 at this time is at an L level, signal a2 appears at line 40. Next, if signal b1 is at an L level, signal a3 appears at line 40; however, since signal b2 at this time is at an H level, signal a1 appears at line 41. When signals b1, b2 are both at an L level, signal a3 appears at line 41. Thus, the digit electrode drive signals illustrated in FIG. 3 are obtained, each possessing excitation potential levels for ⅔ of 1 frame time.

Figure 11:
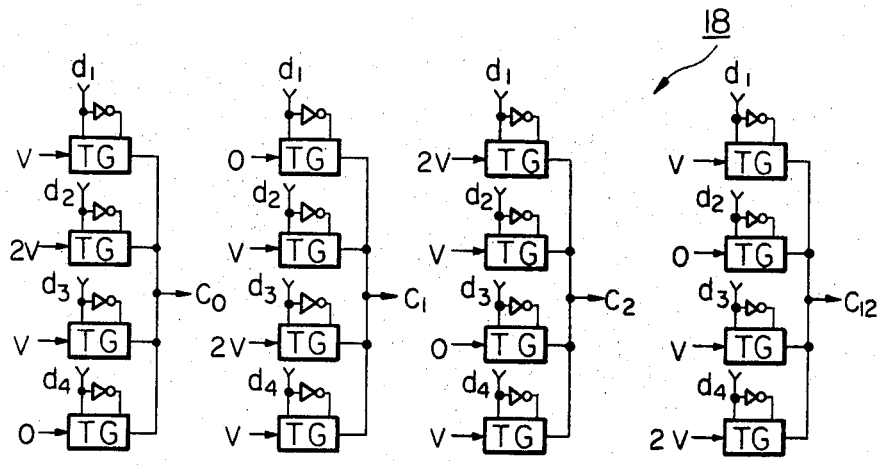
FIG. 11 shows a segment electrode drive signal generator forming part of the drive system shown in FIG. 5.

FIG. 11 illustrates the segment drive signal generator 18. The signals d1, d2, d3, d4 shown in FIG. 9, as well as their inverted versions $\overline{d1}$, $\overline{d2}$, $\overline{d3}$, $\overline{d4}$ are applied as control signals to the electrodes of respective transmission gates TG to which are distributed the O, V, 2V output voltages from the power source circuitry at a timing determined hy the control signals. The generator produces the segment drive signals Co, C1, C2, C12 in response to these input signals. Although the potentials O, V, 2V are used here for descriptive purposes, they correspond to the values −1, 0, +1 which were employed when describing the waveforms above.

Figure 12:
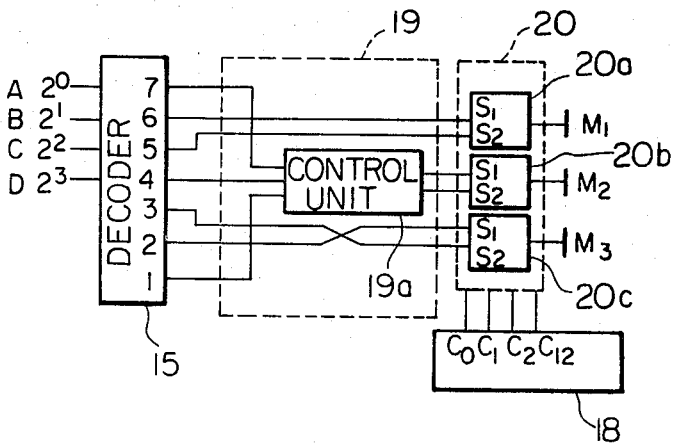
FIG. 12 shows a block wiring diagram of a decoder output signal control circuit forming part of the drive system shown in FIG. 5.
Figure 13:
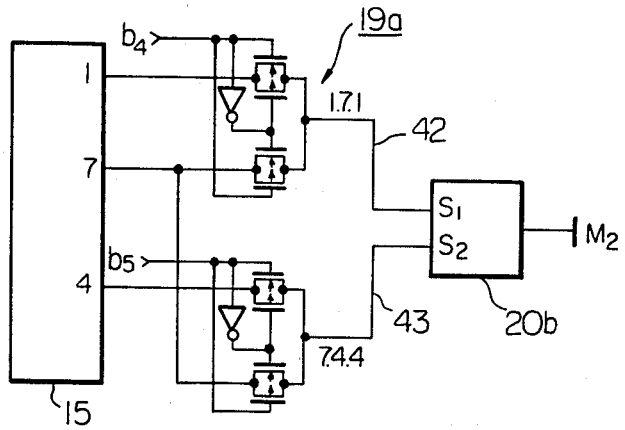
FIG. 13 illustrates a control unit forming part of the decoder output signal control circuit.

FIG. 12 illustrates a block wiring diagram of a decoder output signal control circuit corresponding to a certain single digit, and FIG. 13 depicts a concrete embodiment of the control circuit. Decoder circuit 15 has applied thereto signals A, B, C, D from the logic circuit 13 (see FIG. 5) and converts these signals to 7-segment information signals. The decoder circuit is well known in the art and its detailed description shall therefore be omitted. Referring also to FIG. 6D, electrode M2 comprises three display elements identified by numerals 1, 7, 4, as described above. In FIG. 12, the decoder output signal output circuit 19 comprises a control unit **19*a* which is adapted to select the decoder signals that are applied to segment electrode driver 20*b*** in compliance with the excited digit electrodes. During time interval t1, when digit electrodes r1, r2 are being excited, information related to display elements 1 and 7 is applied to terminals s1, s2 of segment electrode driver circuit 20*b*. During the next time interval t2, digit electrodes r2, r3 are being excited, so that the segment electrode driver circuit is supplied with an information signal for display elements 7 and 4. Similarly, an information signal relating to display elements 1 and 4 is applied during time interval t3 when digit electrodes r1, r3 are being excited. Further, since electrodes M1 and M3 are connected solely to digit electrodes r1, r2, segment electrode drivers 20*a* and 20*c* are directly applied with decoder signals for the display elements 6, 5 and 2, 3, respectively. For example, the segment electrode driver 20 may be constructed such that, in the case of electrode M1, signals for display elements 5, 6 are applied to input terminals s1, s2 during time interval t1, a signal for display element 5 is applied to input terminal s1 and, for example, an L logic level 0 potential to terminal s2 during time interval t2. During time interval t3, a signal for display element 6 can be applied to terminal s1, and an L logic level 0 potential can be coupled to terminal s2. In this manner the decoder output signals can be controlled by the abovementioned control signals. It is also possible to provide control circuits such as control circuit 19*a* for the electrodes M1 and M3; in such a case, information concerning display elements 6, 5 and the 0 potential output would be controlled.

FIG. 13 shows an embodiment of the control unit 19*a* shown in FIG. 12. Decoder output signals 1, 7, 4 are controlled in response to the output signals b4, b5 obtained from timing signal generator 16. During time interval ti, signal b4 is at an H level and signal b5 at an L level, and lines 42, 43 supply the input terminals s1, s2 of segment electrode driver 20*b* with signals for display elements 1 and 7. During time interval t2, signals for elements 7 and 4 arrive, and during time interval t3, signals for elements 1 and 4.

Figure 14:
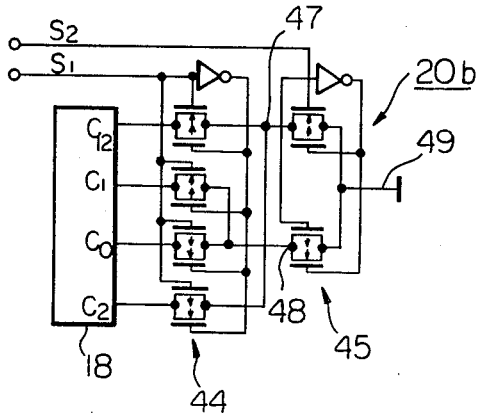
FIG. 14 shows a segment electrode driver forming part of the drive system shown in FIG. 5.

FIG. 14 illustrates an example of a segment electrode driver 20. The driver 20 may, for example, correspond to the driver 20*b* for electrode M2 in FIG. 12, and comprise four transmission gates 44 and two transmission gates 45. In a case where control signals s1, s2 applied to the control gates of transmission gates 44, 45 are at an H logic level, signals C12 appears at point 47, and C1 at point 48, thereby providing C12 at the output 49. Thus, any one of the four segment drive signals C0, C1, C2, C12 can be applied to a segment electrode depending upon the combination of H and L logic levels of signals s1, s2.

In the present embodiment, segment drive signals are produced in advance by the segment drive signal generator, these segment drive signals which correspond to light-transparent or light-scattering states being applied to each electrode in response to the decoder output signals. However, it is also permissable to use a driver adapted to produce the signals C0, C1, C2, C12 directly from the decoder output signals.

A drive system will now be illustrated for another example in which n=4.

Figure 15:
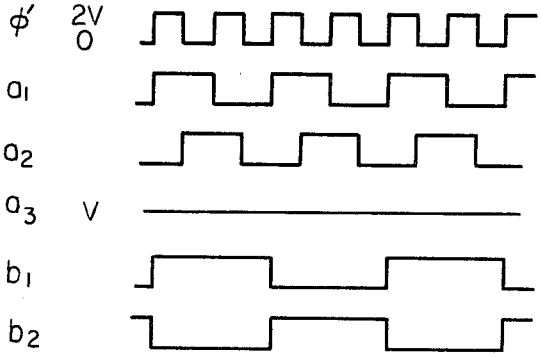
FIG. 15 is a timing chart of control signals when n=4.

FIG. 15 illustrates timing signals produced by timing signal generator 16 shown in FIG. 5. The signals a1, a2, a3 are identical to those of FIG. 8, although signals b1, b2 are obtained as output signals when signal a1 is applied to the divide-by-2 frequency divider; signal b2 is obtained by inverting signal b1.

Figure 16:
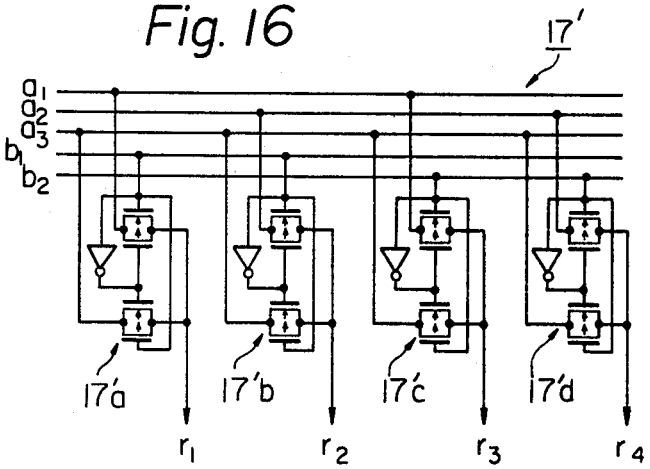
FIG. 16 shows a digit electrode driver forming part of the drive system shown in FIG. 5.

FIG. 16 shows an embodiment of a digit electrode driver 17′ adapted to produce signals r1, r2, r3, r4 in response to the abovementioned timing signals. The digit electrode driver 17′ comprises a plurality of electronic switching means 17′*a* to 17′*d* each composed of a pair of transmission gates. With respect to r1, signal a1 is output when signal b1 is at an H level, and signal a3 when signal b1 is at an L level. This allows the driving signals of FIG. 4 to be obtained.

Figure 17A:
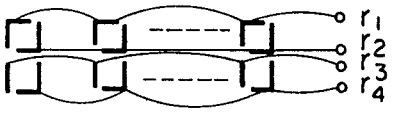
FIGS. 17A and 17B show electrode divisions when n=4.
Figure 17B:
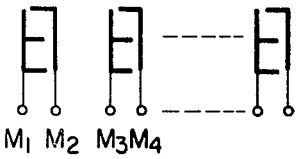

FIGS. 17A and 17B illustrate another example of the electrode divisions for a 7-segment display of a numeral, wherein FIG. 17A shows the digit electrode divisions, and FIG. 17B the segment electrode divisions corresponding to the digit electrodes.

Figure 18A:
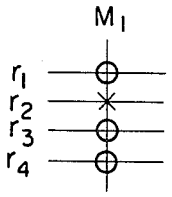
FIGS. 18A and 18B illustrate a display pattern when n=4.
Figure 18B:
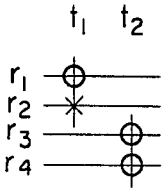

FIG. 18A depicts an example of a pattern of display elements belonging to electrode M1 of a certain digit. The display elements at digit electrodes r1, r3, r4 are shown in a light-transparent state, and the element at digit electrode r2 is shown in a light-scattering state. FIG. 18B illustrates how the segment electrode drive signals are applied with respect to time. Since digit electrodes r1, r2 are being excited during time t1, the segment electrode drive signal C1 is applied in compliance with the pattern of display elements belonging to the digit electrodes r1, r2. Since digit electrodes r3, r4 are being excited during time t2, segment electrode drive signal C12 is applied. In this manner signals C1 and C2 are divided and applied responsive to the timing pulses b4, b5 during 1 frame time of the digit electrode drive signals.

Figure 19:
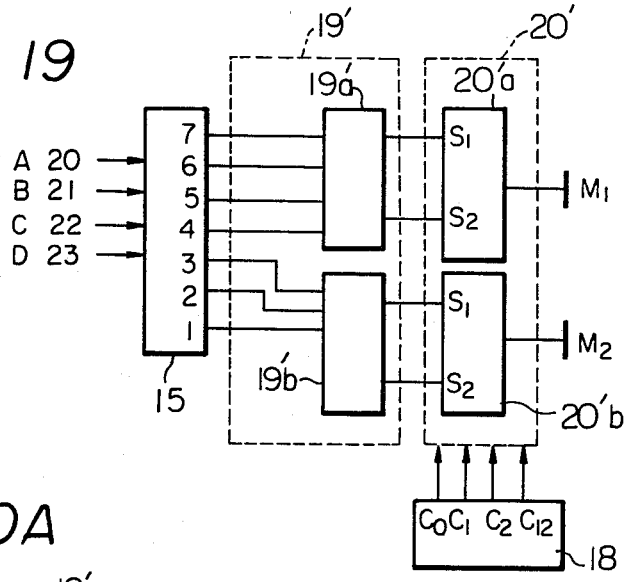
FIG. 19 is a block wiring diagram of a modified form of the decoder output signal control circuit.

FIG. 19 illustrates a block wiring diagram of a decoder output signal control circuit for a single digit. Block 19′ a is adapted to apply segment electrode driver 20′ with signals for display elements 7, 6, 5, 4 which belong to electrode M1; in response to timing signals, signals for display elements 67 are applied during time interval t1, and for display elements 4, 5 during time interval t2. Block 19′*b* is adapted to apply the segment electrode driver with signals for display elements 3, 2, 1 that belong to electrode M2, signals for elements 1, 2 being applied during time t1, and for display element 3 during time t2.

Figure 20A:
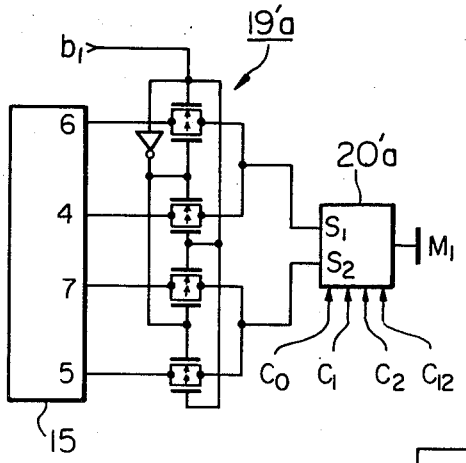
FIGS. 20A and 20B shows control units of the decoder output signal control circuit of FIG. 19.
Figure 20B:
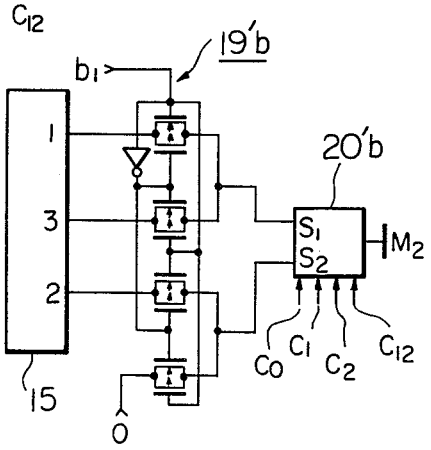

FIG. 20A depicts an embodiment of a control unit 19′*a* of the decoder output signal control circuit 19′. In FIG. 2A, decoder output signals for display segments 6 and 7 are applied to terminals s1, s2 of segment electrode driver 20′*a* when signal b1 is at an H level, whereas signals for display elements 4 and 5 are similarly applied when signal b1 is at an L level. In FIG. 20B, segment electrode driver 20′*b* is likewise applied with signals for display elements 1 and 2 when b1 is at an H level, and with a signal for element 2 when b1 is at an L level. The construction of the segment electrode driver is the same as described with respect to FIG. 14.

Although examples have been described above in which n=3 and n=4, entirely the same results can be obtained for any n-digit matrix, and the same circuit arrangement can be employed to display any arbitrary pattern in addition to a numeric pattern.

The drive circuit of the present invention, unlike that of the prior art, applies two digit electrodes simultaneously with driving signals at a potential other than a reference potential, and applies the remaining (n−2) digit electrodes with driving signals at the reference potential, whereby each digit electrode is addresed for a duration twice that of the prior art. To obtain the operation margin, that is, the ratio of the rms voltage $V_{on}$ at display elements in a light-scattering state to the rms voltage $V_{off}$ at display elements in a light-transparent state using the matrix drive signals produced by the drive circuit of the present invention, it can readily be understood, from the description rendered with regard to FIGS. 3 and 4, that $$V_{on} = \sqrt{4V^2 + \frac{n}{2} V^2/n} = \sqrt{n + 8/2n} \cdot V,$$

$$V_{off} = \sqrt{\tfrac{1}{2}} \cdot V,$$

so that the operation margin is $$V_{on}/V_{off} = \sqrt{1 + \frac{8}{n}}.$$

This agrees with the operation margin for the case of a drive system based on a $\frac{1}{3}$ bias method.

Figure 21:
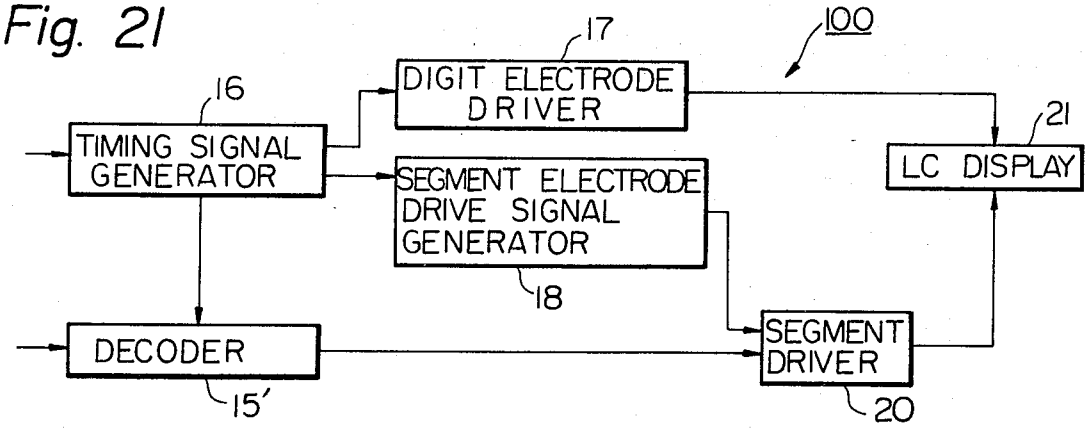
FIG. 21 is a block wiring diagram of another preferred embodiment of a portion of a drive system in accordance with the present invention.

FIG. 21 is a block diagram of another embodiment of a drive system 100 according to the invention. Here, timing signals are coupled directly to decoder circuit 15' where the decode signals are controlled before being applied to segment driver 20.

Figure 22:
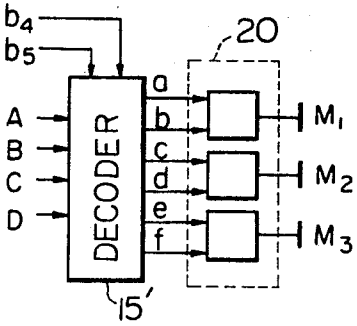
FIG. 22 is a block wiring diagram of a decoder circuit forming part of the system shown in FIG. 21.

FIG. 22 illustrates an example where n=3, wherein decode signals a, b, c, d, e, f are produced responsive to signals b4, b5. The decode signals for each display element appear in compliance with the timing of signals b4, b5. For example, if it is assumed that the signals c, d correspond to the signals for the display elements 1, 4, 7 in FIG. 12, during time t1 c corresponds to the signal for display element 1 and d corresponds to the signal for display element 7.

In accordance with the drive circuit of the present invention as described above, a liquid crystal display which exhibits a higher operation margin than that formerly available can be obtained, wherein merely controlling the decoder output signals allows the segment electrode and digit electrode drive circuits to be readily constructed. Moreover, overall circuit design can be simplified since any arbitrary pattern can be displayed by utilizing only four different segment electrode drive signals.

What is claimed is:

1. In a liquid crystal display device comprising:

a plurality of row conductors;

a plurality of column conductors each intersecting said row conductors in a matrix configuration so that intersections define a display element whereby an electric potential applied across a pair of said row and column conductors above a threshold value energies and turns on said display element;

means for cyclically applying electrical row drive signals to said row conductors, said row drive signals having a cycle time T divided into an integral number of excitation intervals of predetermined duration;

means for cyclically applying electrical column drive signals to said column conductors, said column drive signals varying, in said excitation intervals, at first and second potential levels and a reference potential level between said first and second potential levels whereby when the electric potential caused by said row and column drive signals applied to said row and column conductors respectively is above said threshold value said display element attain a display state whereas when said electric potential is below said threshold value said display element attain a non-display state;

the improvement wherein:

said row drive signals have said first and second potential levels, different from said reference potential level, during one of said excitation intervals and said row drive signals have an identical potential level equal to one of said first and second potential levels and different from said reference potential level during the other of said excitation intervals of said predetermined duration.

2. In a liquid crystal display device comprising:

first and second row conductors;

a plurality of column conductors each intersecting said row conductors in a matrix configuration so that intersections define a display element whereby an electric potential applied across a pair of said row and column conductors above a threshold value energizes and turns on said display element;

means for cyclically applying electrical first and second row drive signals to said first and second row conductors, respectively, said row drive signals having a cycle time T divided into first and second excitation intervals of predetermined duration;

means for cyclically applying electrical column drive signals to said plurality of column conductors, said column drive signals varying, in said excitation intervals, at first and second potential levels and a reference potential level between said first and second potential levels when whereby the electric potential caused by said row and column drive signals applied to said row and column conductors respectively is above said threshold value said display element attain a display state whereas when said electric potential is below said threshold value said display element attain a non-display state;

the improvement wherein:

said first and second row drive signals have said first and second potential levels, respectively, different from said reference potential level, during said first excitation interval and said row drive signals have an identical potential level equal to one of said first and second potential levels and different from said reference potential level during said second excitation interval of said predetermined duration, whereby either said first and second row conductors can be excited during either one of said excitation intervals.

3. In a liquid crystal display device comprising:

a plurality of row conductors;

a plurality of column conductors each intersecting said row conductors in a matrix configuration so that intersections define a display element whereby an electric potential applied across a pair of said row and column conductors above a threshold value energizes and turns on said display element;

means for cyclically applying electrical row drive signals to said row conductors, said row drive signals having a cycle time T divided into an integral number of excitation intervals of predetermined duration;

means for cyclically applying electrical column drive signals to said column conductors, said column drive signals varying, in said excitation intervals, at first and second potential levels and a reference potential level between said first and second potential levels whereby when the electric potential caused by said row and column drive signals applied to said row and column conductors respectively is above said threshold value said display element attain a display state whereas when said electric potential is below said threshold value said display element attain a non-display state;

the improvement wherein:

a pair of selected ones of said row drive signals have said first and second potential levels, different from said reference potential level, during one of said excitation intervals and simultaneously a remaining one of said row drive signals has said reference potential level, whereas, during another one of said excitation intervals, another pair of the other selected ones of said row drive signals have said first and second potential levels and simultaneously another remaining one of said row drive signals has said reference potential level, whereby two adjacent row conductors at a time are selected by said row drive signals, to enable display elements associated therewith to be driven into excitation.

* * * * *